US008808154B2

(12) United States Patent
Wagenbauer et al.

(10) Patent No.: US 8,808,154 B2
(45) Date of Patent: Aug. 19, 2014

(54) DRIVE APPARATUS IN A SCROLL CENTRIFUGE HAVING A GEARBOX WITH A HOUSING NONROTATABLY CONNECTED TO A DRIVE SHAFT

(75) Inventors: Robert Wagenbauer, Wurmsham (DE); Christoph Puls, Karlsruhe (DE)

(73) Assignee: Hiller GmbH, Vilsbiburg (DE)

( * ) Notice: Subject to any disclaimer, the term of this patent is extended or adjusted under 35 U.S.C. 154(b) by 0 days.

(21) Appl. No.: 13/818,592

(22) PCT Filed: Jun. 14, 2011

(86) PCT No.: PCT/EP2011/059815

§ 371 (c)(1),
(2), (4) Date: Apr. 25, 2013

(87) PCT Pub. No.: WO2012/034722

PCT Pub. Date: Mar. 22, 2012

(65) Prior Publication Data

US 2013/0231235 A1 Sep. 5, 2013

(30) Foreign Application Priority Data

Sep. 13, 2010 (DE) ..... 10 2010 037 488

(51) Int. Cl.
*B04B 1/20* (2006.01)
*B04B 9/08* (2006.01)

(52) U.S. Cl.
USPC ..... 494/15; 494/53; 494/84

(58) Field of Classification Search
USPC ..... 494/50–54, 83–84, 15; 210/380.3; 475/1–349
See application file for complete search history.

(56) References Cited

U.S. PATENT DOCUMENTS

| | | | | | |
|---|---|---|---|---|---|
| 1,383,313 | A | * | 7/1921 | Landreth | 494/53 |
| 1,572,612 | A | * | 2/1926 | Laughlin | 494/51 |
| 1,611,989 | A | * | 12/1926 | Behr | 475/329 |
| 1,655,426 | A | * | 1/1928 | Laughlin | 210/374 |
| 1,710,315 | A | * | 4/1929 | Laughlin | 494/53 |
| 1,962,461 | A | * | 6/1934 | Piper | 475/332 |
| 2,557,799 | A | * | 6/1951 | Salmivuori | 74/720 |
| 2,649,816 | A | * | 8/1953 | Kuster et al. | 475/218 |
| 2,703,676 | A | * | 3/1955 | Gooch | 494/42 |
| 2,734,681 | A | * | 2/1956 | Schmiedel | 494/53 |
| 2,867,378 | A | * | 1/1959 | Harlow | 494/8 |
| 3,187,997 | A | * | 6/1965 | Gooch | 494/53 |
| 3,282,497 | A | * | 11/1966 | Schmiedel | 494/37 |
| 3,343,786 | A | * | 9/1967 | Sharples | 494/51 |
| 3,358,841 | A | * | 12/1967 | Khibnik | 210/374 |

(Continued)

FOREIGN PATENT DOCUMENTS

| | | | | |
|---|---|---|---|---|
| DE | 3302974 A1 | * | 8/1984 | B04B 9/00 |
| DE | 3810472 C1 | * | 8/1989 | B04B 1/20 |

(Continued)

*Primary Examiner* — Charles Cooley
(74) *Attorney, Agent, or Firm* — Themis Law

(57) ABSTRACT

A drive apparatus for a scroll centrifuge having a rotating drum and a scroll mounted coaxially therein has a drive motor associated with the drum and a scroll motor that is coupled to the scroll shaft via a gearbox whose housing is nonrotatably connected to the drum drive shaft. According to the invention, the housing of the gearbox for driving the scroll is rotatably mounted in a floor-mounted housing and has a hollow output shaft that is connected via a coupling to the hollow drum drive shaft.

10 Claims, 9 Drawing Sheets

(56) References Cited

U.S. PATENT DOCUMENTS

Figure 1:
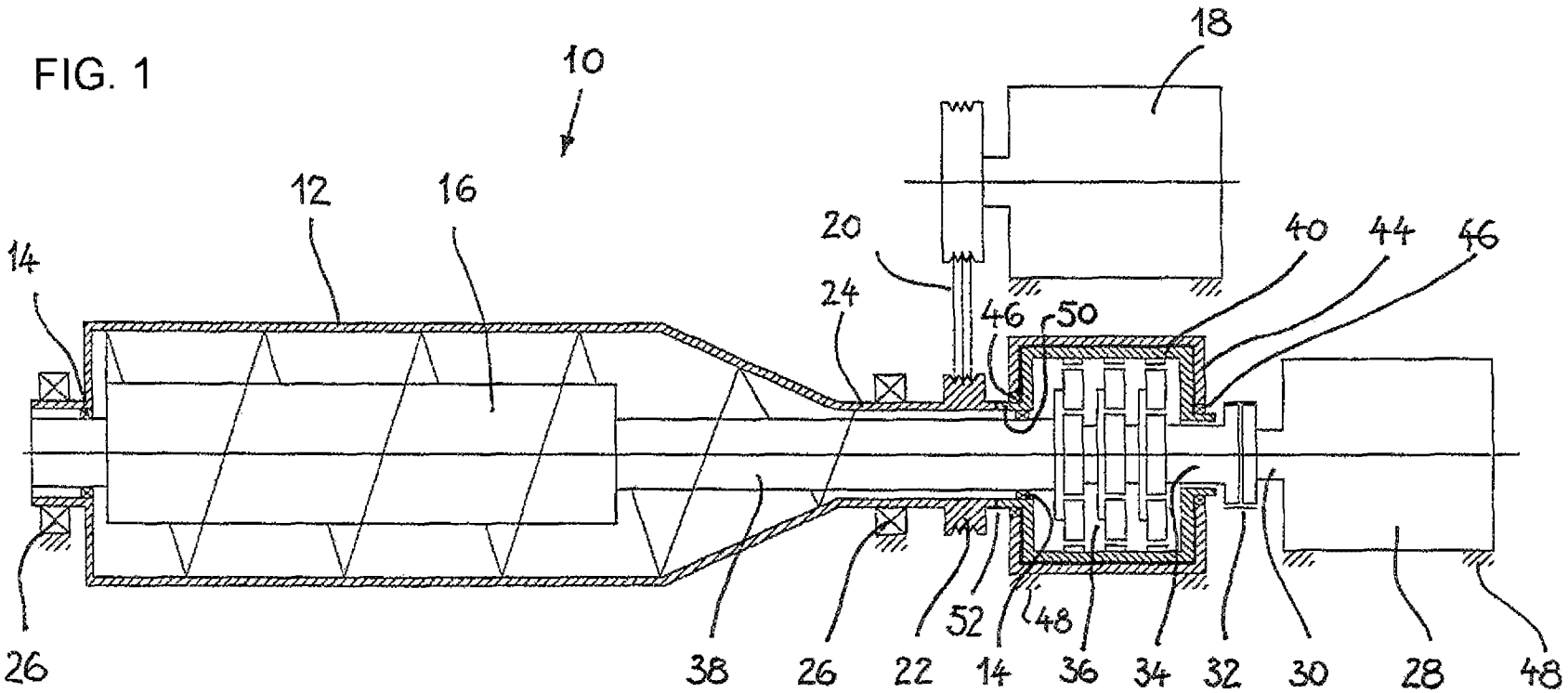

| | | | | | |
|---|---|---|---|---|---|
| 3,419,211 | A * | 12/1968 | Masuichi Yasuda et al. | 494/53 |
| 3,428,247 | A * | 2/1969 | Andresen et al. | 494/15 |
| 3,599,861 | A * | 8/1971 | DeMartini | 494/8 |
| 3,685,722 | A * | 8/1972 | Nichols, Jr. | 494/53 |
| 3,734,399 | A * | 5/1973 | Oas | 494/8 |
| 3,923,241 | A * | 12/1975 | Cyphelly | 494/53 |
| 3,967,778 | A * | 7/1976 | Hunwick | 494/29 |
| 4,069,966 | A * | 1/1978 | Crosby et al. | 494/53 |
| 4,069,967 | A * | 1/1978 | Crosby et al. | 494/53 |
| 4,129,249 | A * | 12/1978 | Todd | 494/53 |
| 4,298,162 | A * | 11/1981 | Hohne | 494/53 |
| 4,299,353 | A * | 11/1981 | Bruning et al. | 494/8 |
| 4,327,862 | A * | 5/1982 | Jakobs | 494/37 |
| 4,334,647 | A * | 6/1982 | Taylor | 494/37 |
| 4,421,502 | A * | 12/1983 | Jakobs | 494/7 |
| 4,432,747 | A * | 2/1984 | Posse et al. | 494/8 |
| 4,504,262 | A * | 3/1985 | Forsberg | 494/53 |
| 5,037,372 | A * | 8/1991 | Weder | 494/53 |
| 5,120,298 | A * | 6/1992 | Jager | 494/53 |
| 5,197,939 | A * | 3/1993 | Cederkvist et al. | 494/53 |
| 5,364,335 | A * | 11/1994 | Franzen et al. | 494/15 |
| 5,403,260 | A * | 4/1995 | Hensley | 494/53 |
| 5,529,566 | A * | 6/1996 | Weil | 494/1 |
| 5,558,769 | A * | 9/1996 | Witthaus et al. | 210/360.1 |
| 5,714,858 | A * | 2/1998 | Pieralisi | 318/539 |
| 5,772,573 | A * | 6/1998 | Hao | 494/15 |
| 5,941,810 | A * | 8/1999 | Gay | 494/53 |
| 6,056,685 | A * | 5/2000 | Nelson | 494/53 |
| 6,155,964 | A * | 12/2000 | Hensley | 494/9 |
| 6,387,032 | B1 * | 5/2002 | Beyer | 494/53 |
| 6,589,154 | B2 * | 7/2003 | Caldwell | 494/53 |
| 7,041,044 | B2 * | 5/2006 | Gilbert | 494/53 |
| 7,358,635 | B2 * | 4/2008 | Fout et al. | 310/103 |
| 7,431,684 | B2 * | 10/2008 | Cunningham et al. | 494/7 |
| 7,438,678 | B2 * | 10/2008 | Beyer | 494/53 |
| 7,547,273 | B2 * | 6/2009 | Haider | 494/84 |
| 7,670,276 | B2 * | 3/2010 | Fujimoto et al. | 494/53 |
| 7,883,457 | B2 * | 2/2011 | Overberg | 494/53 |
| 7,908,764 | B1 * | 3/2011 | Estes et al. | 34/58 |
| 8,042,281 | B1 * | 10/2011 | Estes et al. | 34/312 |
| 8,444,542 | B2 * | 5/2013 | Ostkamp et al. | 494/14 |
| 8,465,406 | B2 * | 6/2013 | Overberg et al. | 494/53 |
| 2002/0183186 | A1 * | 12/2002 | Caldwell | 494/53 |
| 2004/0138040 | A1 * | 7/2004 | Hensley et al. | 494/53 |
| 2006/0014619 | A1 * | 1/2006 | Haider | 494/53 |
| 2006/0183621 | A1 * | 8/2006 | Beyer | 494/53 |
| 2007/0203009 | A1 * | 8/2007 | Cunningham et al. | 494/50 |
| 2008/0196890 | A1 * | 8/2008 | Fout et al. | 166/250.15 |
| 2009/0233781 | A1 * | 9/2009 | Fujimoto et al. | 494/53 |
| 2009/0247384 | A1 * | 10/2009 | Overberg | 494/51 |
| 2010/0167902 | A1 * | 7/2010 | Overberg et al. | 494/66 |
| 2011/0034312 | A1 * | 2/2011 | Ostkamp et al. | 494/14 |
| 2012/0157289 | A1 * | 6/2012 | Kjær | 494/51 |
| 2012/0267303 | A1 * | 10/2012 | Oldeback et al. | 210/374 |
| 2013/0231235 | A1 * | 9/2013 | Wagenbauer et al. | 494/84 |

FOREIGN PATENT DOCUMENTS

| | | | | |
|---|---|---|---|---|
| DE | 4028441 | A1 * | 3/1992 | B04B 1/20 |
| DE | 4107485 | A1 * | 9/1992 | B04B 9/08 |
| DE | 4416904 | C1 * | 6/1995 | B04B 1/20 |
| DE | 4409520 | A1 * | 9/1995 | B04B 9/02 |
| DE | 19806374 | C1 * | 7/1999 | B04B 1/20 |
| EP | 469944 | A2 * | 2/1992 | B04B 1/20 |
| EP | 798046 | A1 * | 10/1997 | B04B 1/20 |
| EP | 1129782 | A2 * | 9/2001 | B04B 1/20 |
| FR | 2610058 | A1 * | 7/1988 | F16H 3/74 |
| GB | 2393142 | A * | 3/2004 | B04B 9/08 |
| JP | 61197062 | A * | 9/1986 | B04B 9/08 |
| JP | 01022366 | A * | 1/1989 | B04B 9/10 |
| JP | 08285017 | A * | 11/1996 | F16H 1/28 |
| JP | 2007038068 | A * | 2/2007 | |
| JP | 2012007634 | A * | 1/2012 | |
| WO | WO 8803439 | A1 * | 5/1988 | B04B 7/08 |
| WO | 8912506 | | 12/1989 | |
| WO | WO 9730791 | A1 * | 8/1997 | B04B 1/20 |
| WO | WO 9942220 | A1 * | 8/1999 | B04B 1/20 |
| WO | WO 9948612 | A1 * | 9/1999 | B04B 1/20 |
| WO | WO 02081094 | A1 * | 10/2002 | B04B 1/20 |
| WO | WO 2004097255 | A2 * | 11/2004 | F16H 1/46 |
| WO | WO 2007147893 | A1 * | 12/2007 | B04B 1/20 |

* cited by examiner

DRIVE APPARATUS IN A SCROLL CENTRIFUGE HAVING A GEARBOX WITH A HOUSING NONROTATABLY CONNECTED TO A DRIVE SHAFT

FIELD OF THE INVENTION

The invention relates to a drive apparatus in a scroll centrifuge.

BACKGROUND OF THE INVENTION

In conventional drive apparatuses of this design having an external gearbox, the housing of the latter is connected rigidly to the rotor drum and forms one large mass mounted in free-floating fashion (see e.g. WO 2007/147893). Imbalances in the gearbox and the rotor then have an extremely disadvantageous effect on the rotor bearings, and are transmitted by them directly into the base for the centrifuge.

To avoid these disadvantages, attempts have therefore already been made to position the drum in elastically suspended bearings or in floating bearing assemblies. Such bearing mounts have not proven successful, however, since narrow gaps between the drum and its housing cannot be maintained, and resonant vibrations moreover occur at specific rotation speeds through which the drive transitions as it is shut off.

In a variant design, a separate gearbox bearing mount is additionally implemented in an independent bearing bracket; a free-floating gearbox having a long bearing shaft results, however, in imbalances on the gearbox side (see Stahl, Dekanterhandbuch [Decanter manual], vol. II, pp. 408-409).

SUMMARY OF THE INVENTION

The underlying object of the invention is to describe a drive apparatus for scroll centrifuges in which the drum drive is decoupled from the scroll drive, and both free-floating mounting of the gearbox for the scroll drive and elastic rotor mounting are avoided.

In a drive apparatus according to one embodiment of the invention, this object is achieved by the features reproduced in the characterizing portion.

The advantages of this approach that are achieved with the invention consist principally in the floor-mounted housing, which ensures a defined bearing mount for the gearbox housing for the scroll drive and makes possible support on the base rather than floating mounting. The hollow output shaft is connected to the drum drive shaft not rigidly but instead via a coupling, which can be embodied for example as a positively engaging toothed coupling and which ensures a separation between the gearbox mass and the rotor mass. Safety is thereby considerably improved as compared with a gearbox mounted in free-floating fashion, with the risk of gearbox breakage.

The drive apparatus embodied according to the present invention permits a lighter construction as compared with the known existing art, with the advantage of longer service life and lower energy consumption.

In an advantageous embodiment, the gearbox has a intermediate gearbox stage having a drive gear, driven by the output shaft of the scroll motor, for a pinion, the axis of the drive gear and the output shaft of the scroll motor being offset with respect to the rotation axis of the scroll and of the pinion. It is thereby possible to guide a lubricant delivery tube through the intermediate gearbox stage coaxially with the rotation axis of the scroll.

BRIEF DESCRIPTION OF THE INVENTION

Figure 1A:
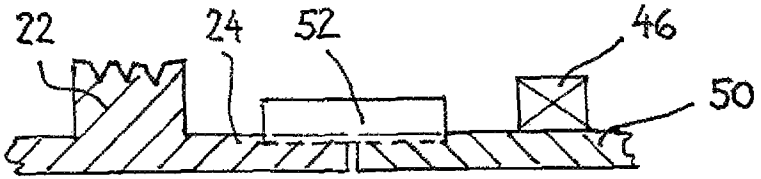
Figure 2:
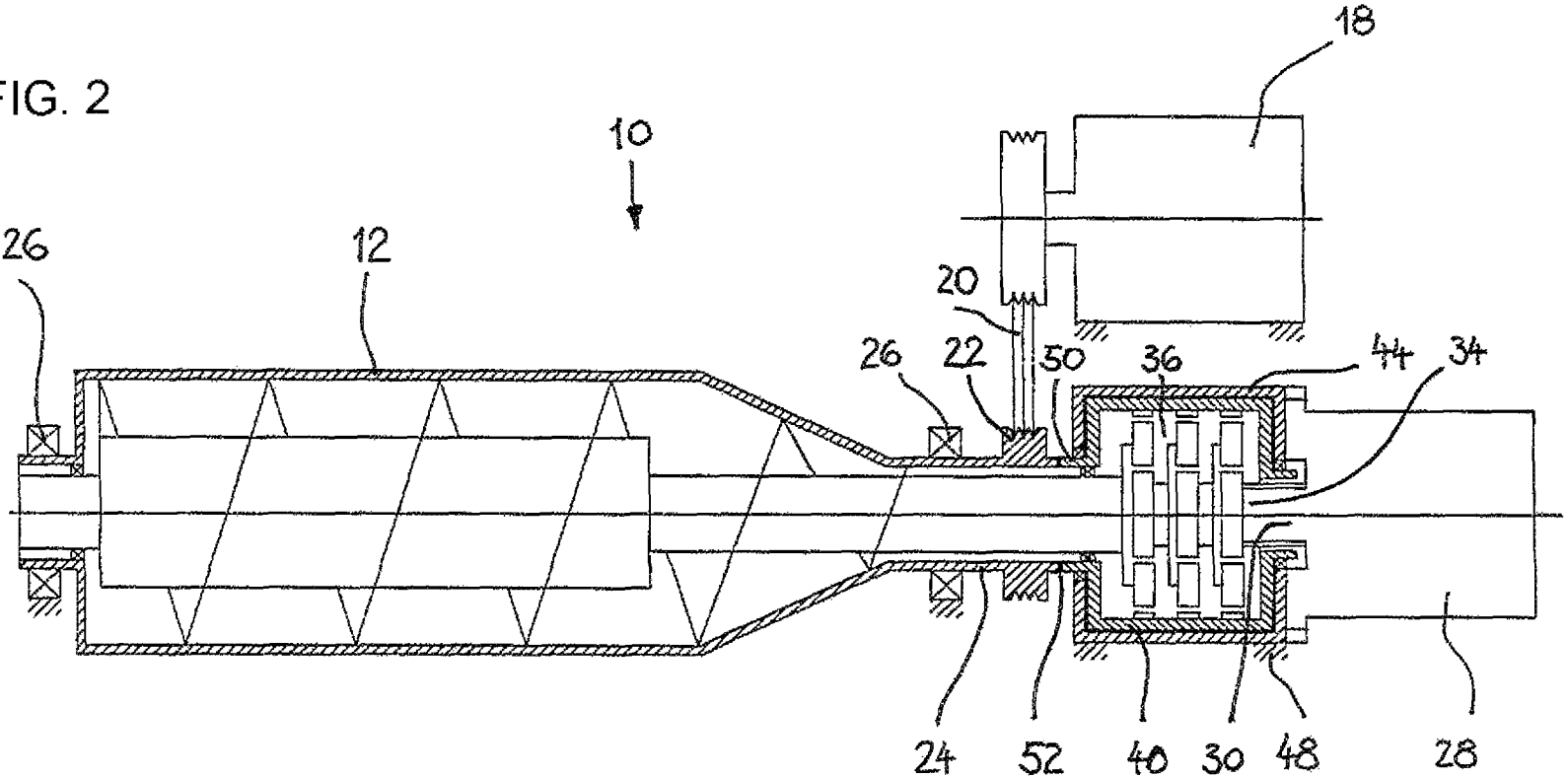
Figure 3:
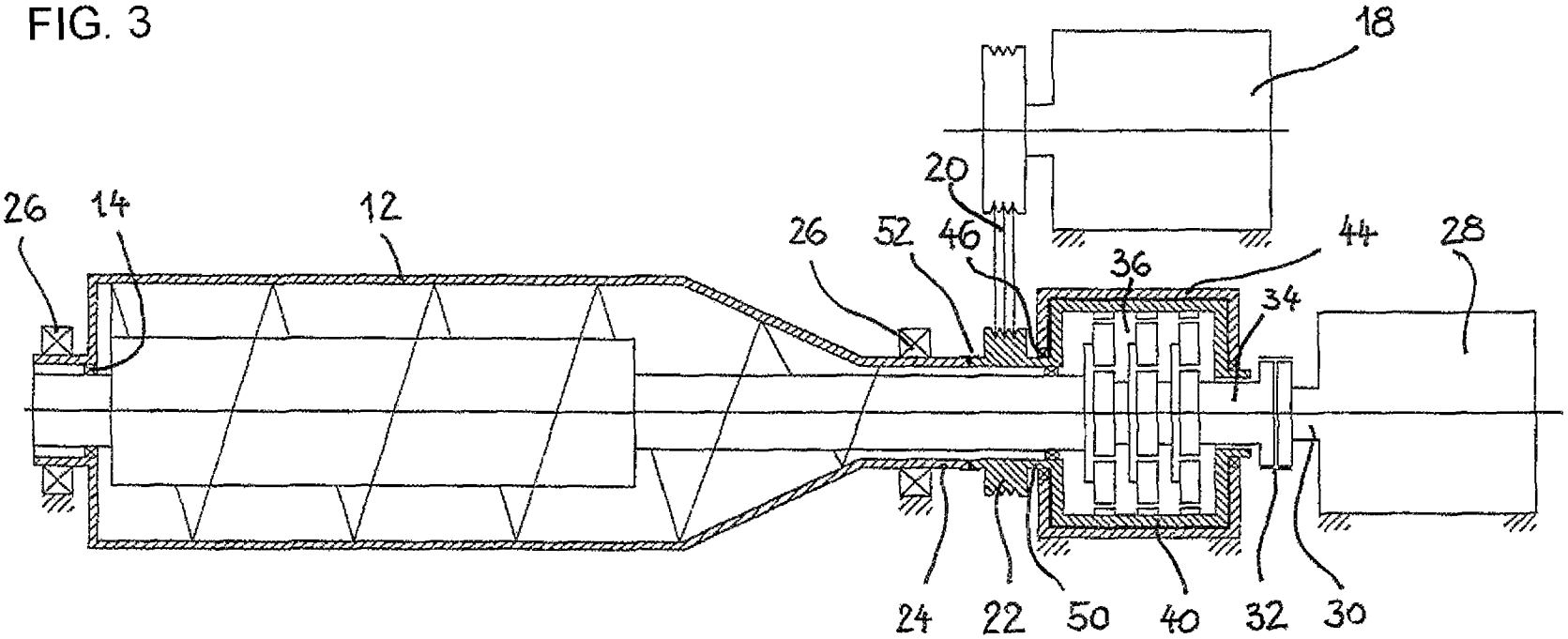
Figure 4:
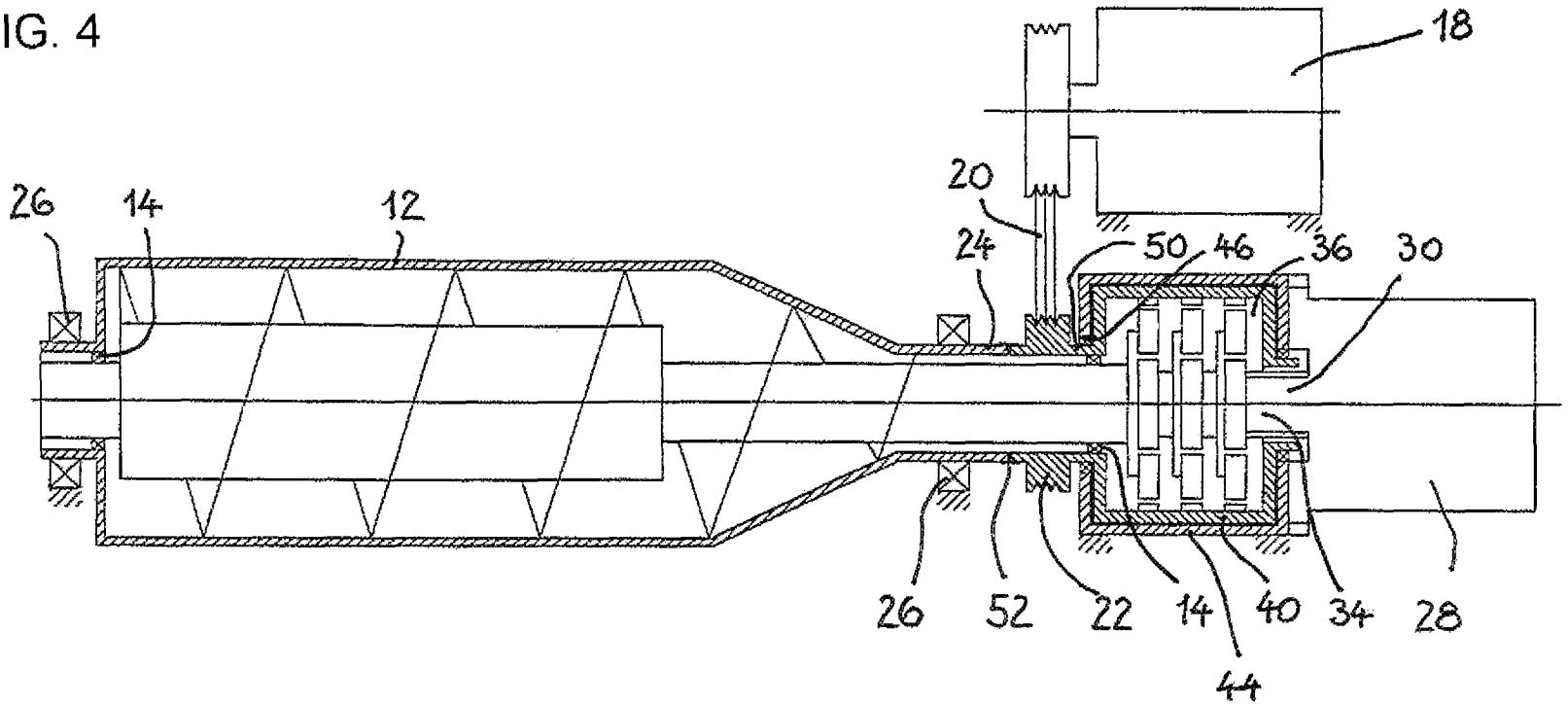
Figure 5:
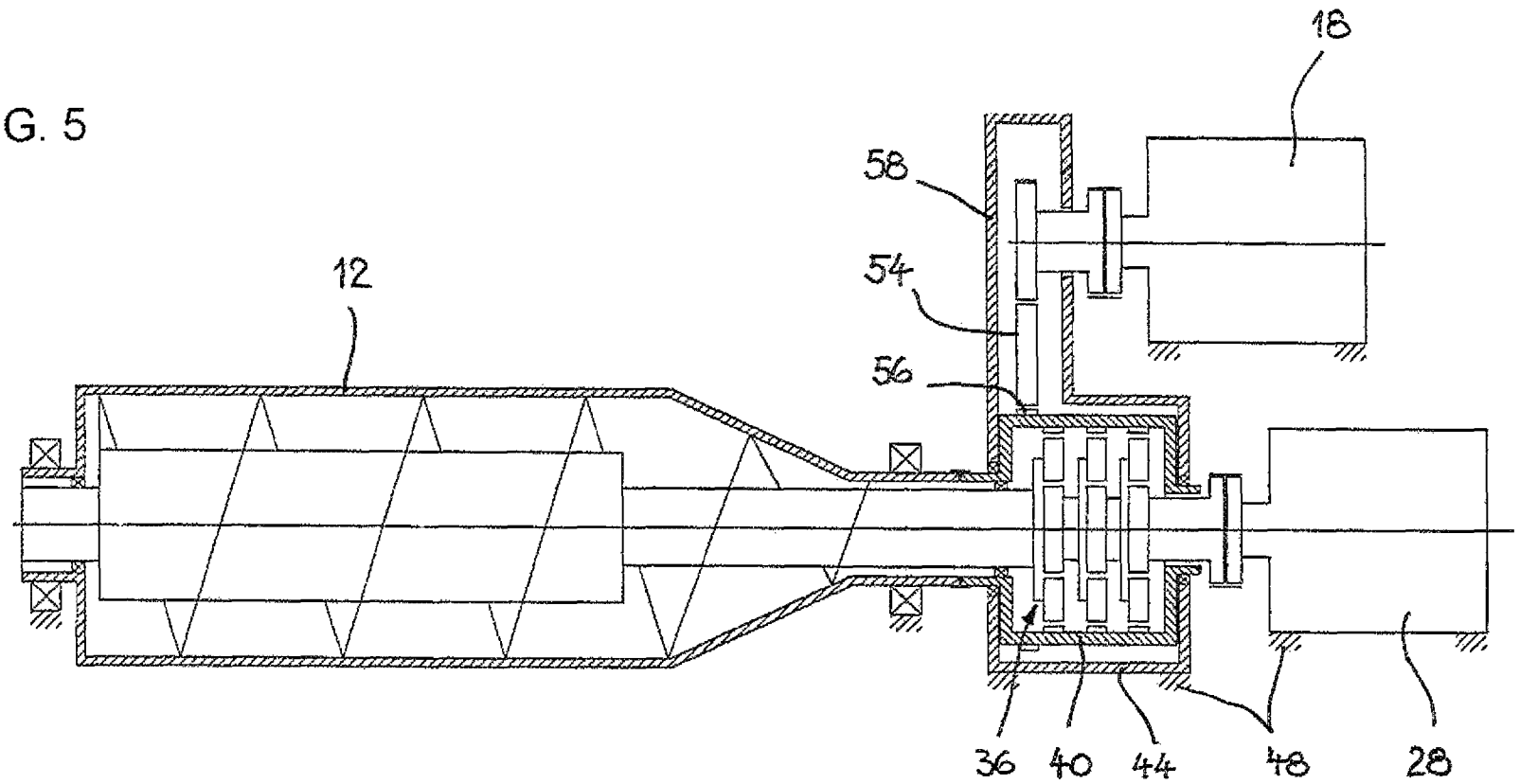
Figure 6:
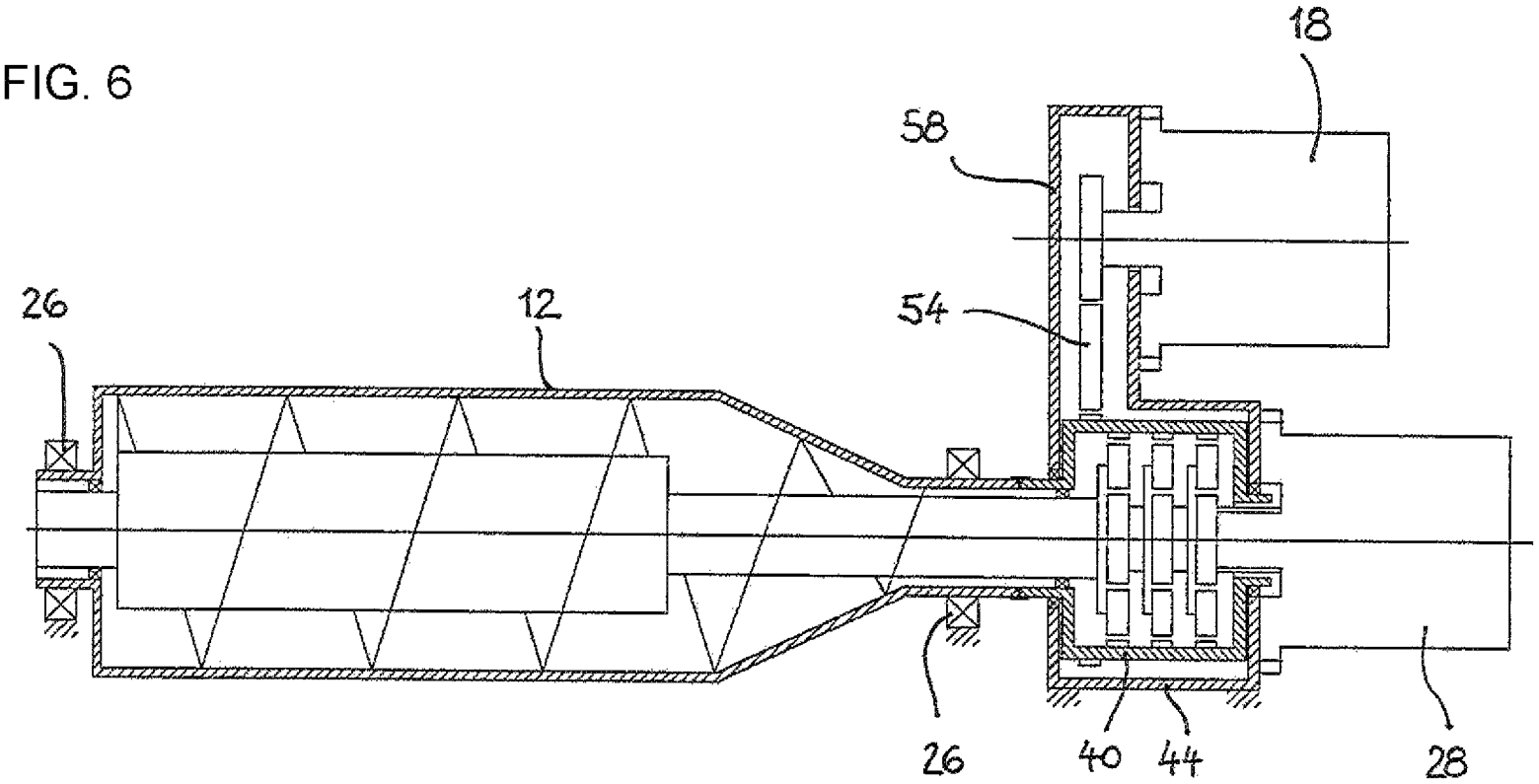
Figure 7:
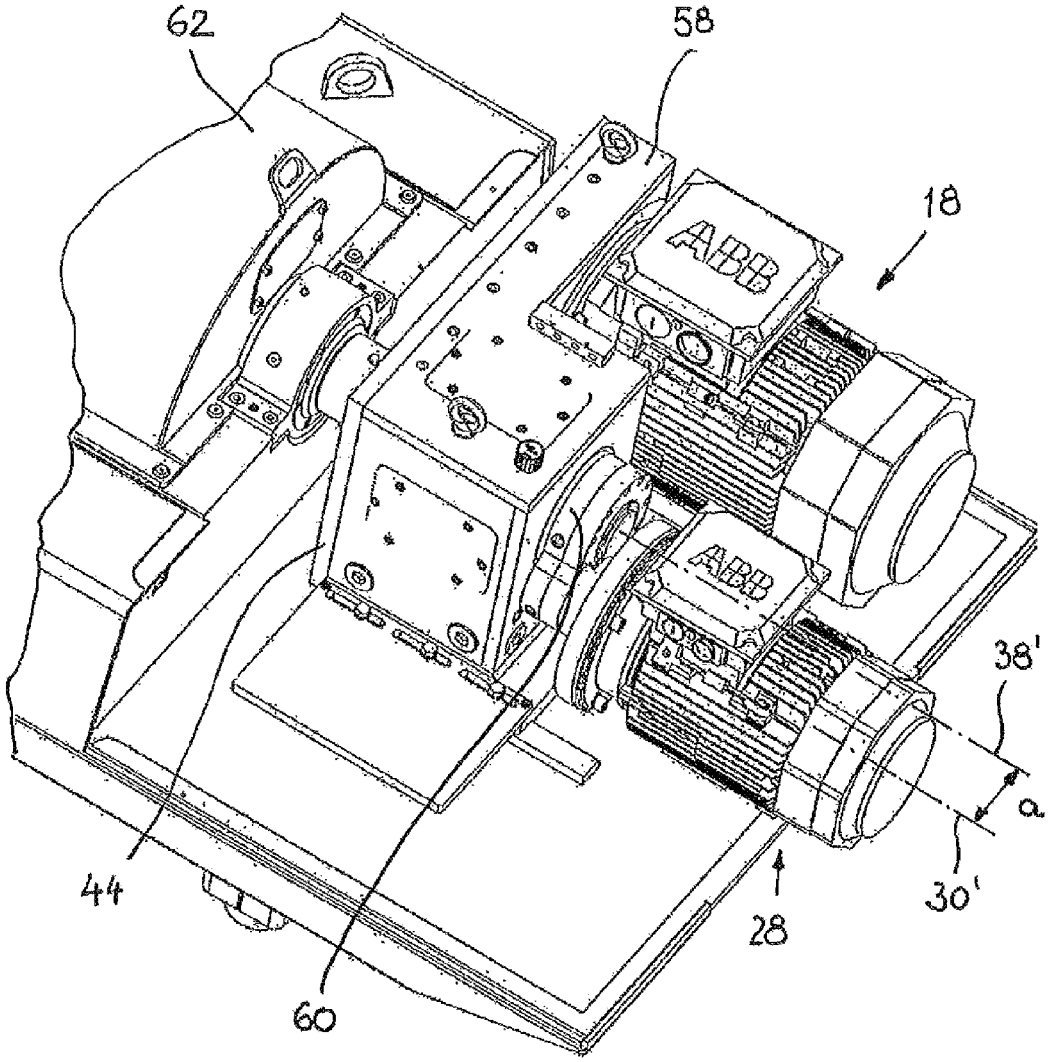
Figure 8:
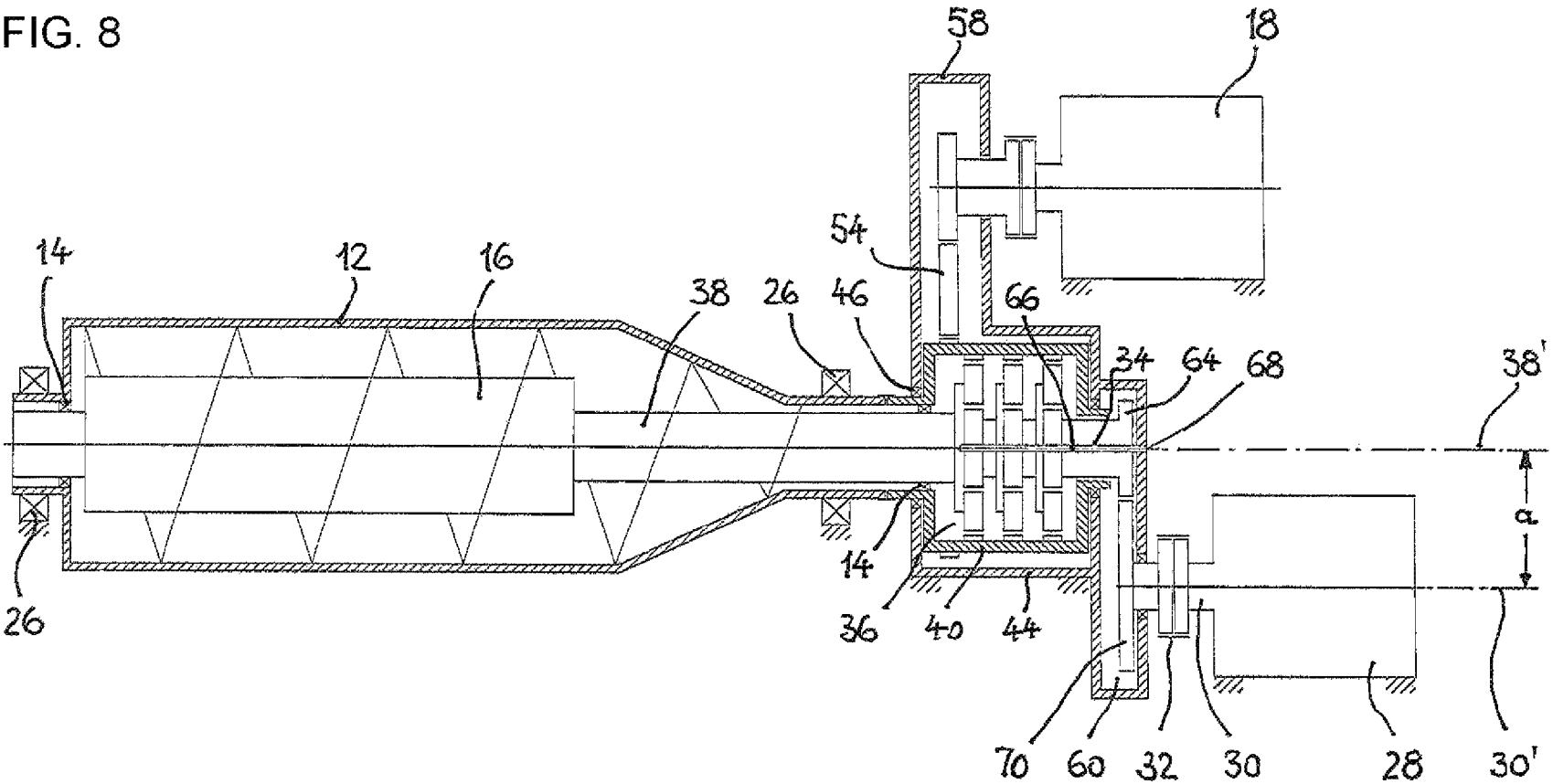
Figure 9:
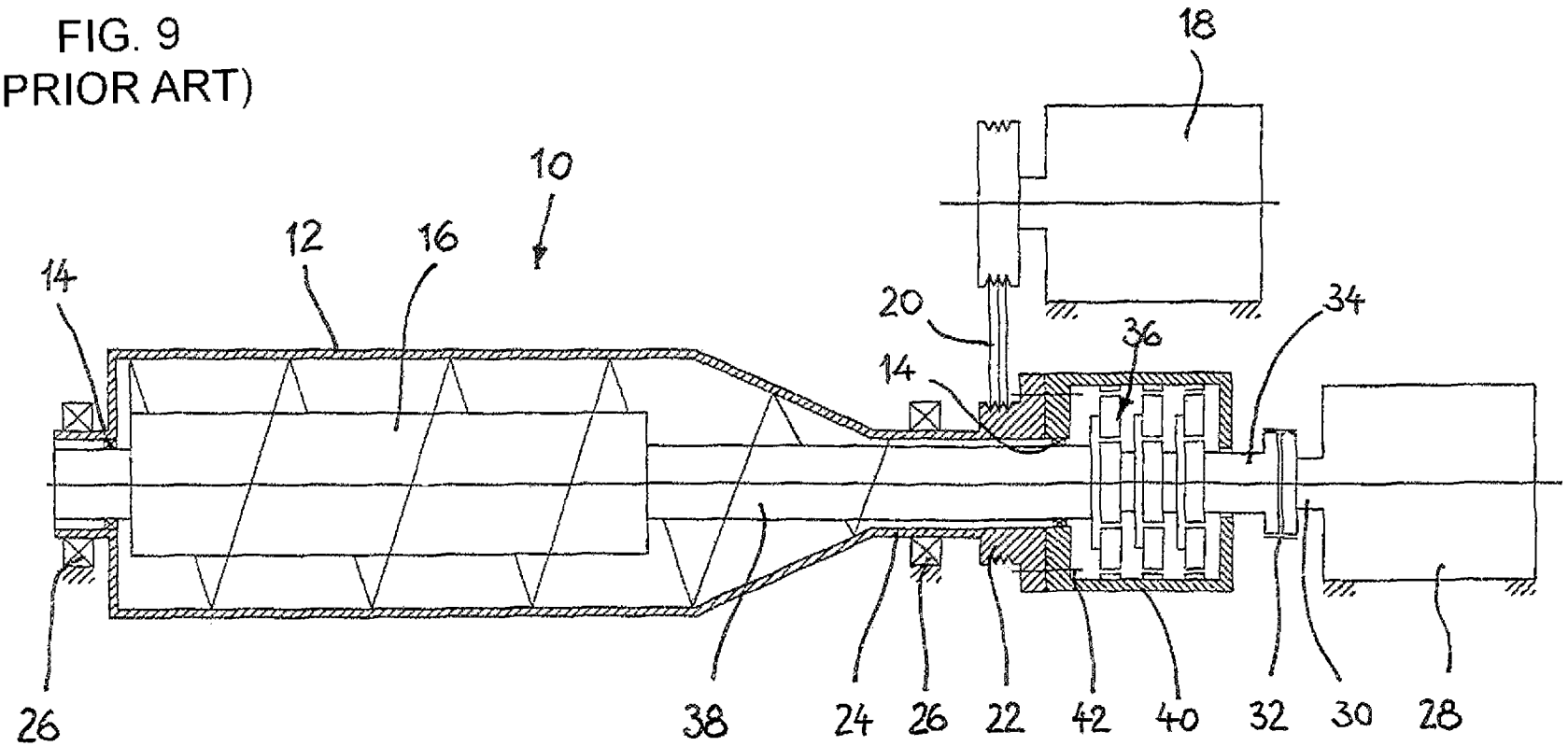
FIG. 9 (PRIOR ART)

Further features and advantages of the invention are evident from the dependent claims and from the description below of exemplifying embodiments that are schematically depicted in the drawings, in which:

FIG. 1 is a longitudinal section through a first exemplifying embodiment, and FIG. 1*a* is a detail view of a toothed coupling, FIG. 2 shows a variant of FIG. 1, FIG. 3 shows a further variant of FIG. 1, FIG. 4 shows a variant of FIG. 3, FIG. 5 shows a further modified exemplifying embodiment, FIG. 6 shows a variant of FIG. 5, and FIG. 7 is a view of a modified embodiment, FIG. 8 is a sectioned depiction of the variant of FIG. 7, and FIG. 9 is a longitudinal section through a design of the existing art.

DETAILED DESCRIPTION OF THE INVENTION

The known design depicted in FIG. 9 shows in longitudinal section a scroll centrifuge 10 having a rotating drum 12 and a scroll 16 mounted therein via two radial bearings 14. Rotational driving of drum 12 is provided by an electric drive motor 18 whose motor shaft imparts rotation, via a belt drive 20, to a belt pulley 22 that is connected fixedly to the hollow drum drive shaft 24. Drum 12 is supported rotatably at both ends in radial bearings 26.

Rotational driving of scroll 16 is provided by a separate scroll motor 28, whose schematically depicted output shaft 30 is coupled via a shaft coupling 32 to input shaft 34 of a gearbox 36 that imparts rotation to scroll shaft 38 at a differential rotation speed differing from the rotor shaft. Gearbox 36 is embodied here as a planetary gearbox and is accommodated in a housing 40 that is connected rigidly, via a schematically indicated bolt connection 42, to belt pulley 22 and thus to drum drive shaft 24.

As depicted in the first exemplifying embodiment of the invention according to FIG. 1, gearbox 36 is decoupled from drum 12 by the fact that its housing 40 is rotatably mounted via two radial bearings 46 in a floor-mounted housing 44 that is supported on a base 48. Housing 40 of gearbox 36 has a hollow output shaft 50 (see FIG. 2) that is connected via a coupling 52 to the hollow drum drive shaft 24.

Gearbox 36 can be a planetary gearbox as depicted, or also a four-shaft gearbox or a hydraulic motor.

Coupling 52 can be embodied as a toothed coupling, for example in the form of an internally toothed sleeve that interconnects the externally toothed ends of output shaft 50 of gearbox 36 and of drum drive shaft 24.

Whereas in the example of FIG. 1, output shaft 30 of scroll motor 28, which (like floor-mounted housing 44) is supported on base 48, is coupled via a shaft coupling 32 to input shaft 34 of gearbox 36, in the variant of FIG. 2, scroll motor 28 is flange-mounted onto floor-mounted housing 44. Output shaft 30 of scroll motor 28 is here connected nonrotatably to input shaft 34 of gearbox 36, or embodied integrally therewith.

In the exemplifying embodiment of FIGS. 1 and 2, belt pulley 22 is fixedly connected to the hollow drum drive shaft 24 mounted in radial bearing 26, while it is connected via coupling 52 to the hollow output shaft 50 of gearbox housing 40. The tensile forces of belt drive 20 are thus absorbed by radial bearing 26. FIG. 1*a* illustrates belt pulley 22 embodied as a toothed pulley.

The exemplifying embodiments of FIGS. 3 and 4 differ from those of FIGS. 1 and 2 in that belt pulley 22 is fixedly connected to the hollow output shaft 50 of gearbox housing 40, while it is connected via coupling 52 to drum drive shaft 24. In this case the tensile forces exerted by belt drive 20 are absorbed by radial bearings 14, 46 of gearbox 36. Whereas in the example of FIG. 3, output shaft 30 of scroll motor 28, which (like floor-mounted housing 44) is supported on base 48, is coupled via a shaft coupling 32 to input shaft 34 of gearbox 36, in the variant of FIG. 4, scroll motor 28 is flange-mounted onto floor-mounted housing 44. Output shaft 30 of scroll motor 28 is here connected nonrotatably to input shaft 34 of gearbox 36, or embodied integrally therewith.

FIG. 5 shows a further possibility for embodying the invention, in which the gearbox arrangement between drive motor 18 and drum 12 is made up of a spur gear gearbox 54 that is in engagement with an external tooth set 56 on housing 40 of gearbox 36. Here housing 58 of spur gear gearbox 54 is moreover fixedly connected to floor-mounted housing 44 or embodied integrally therewith.

As FIG. 6 shows, this variant of FIG. 5 offers the possibility of embodying drive motor 18 for drum 12 as a flange motor, and attaching it to housing 58 of spur gear gearbox 54.

FIGS. 7 and 8 show, as a variant of FIG. 5, a further embodiment in which gearbox 36 has a intermediate gearbox stage 60 having two rotation axes offset from one another. Scroll motor 28 is offset with its output shaft 30, whose axis is indicated as 30', by dimension a with respect to rotation axis 38' of scroll shaft 38 and of drum 12 coaxial therewith. Drum 12 is accommodated in a drum housing 62 (see FIG. 7).

Intermediate gearbox stage 60 has a drive gear 70 driven by scroll motor 28 and having rotation axis 30', which gear is connected to output shaft 30 of scroll motor 28 via coupling 32 and meshes with a pinion 64 of intermediate gearbox stage 60. Pinion 64 is fixedly connected to input shaft 34 of gearbox 36.

The axial offset a between the two axes 30' and 38' is utilized in order to guide through the entire gearbox 36, a delivery tube 66 that is coaxial with axis 38' and has a centered access 68 for lubricant that is distributed to the requisite lubrication points via radial orifices (not further depicted) in delivery tube 66. Targeted oil injection lubrication from inside is thereby made possible, thereby avoiding common problems with decanter gearboxes, for example churning in the context of usual sump lubrication systems.

The invention claimed is:

1. A drive apparatus in a scroll centrifuge comprising:
a rotating drum (12);
a scroll (16) mounted coaxially therein;
a drive motor (18) associated with the drum (12); and
a scroll motor (28) coupled to a scroll shaft (38) via a gearbox (36) having a housing (40) nonrotatably connected to a hollow drum drive shaft (24),
wherein the housing (40) of the gearbox (36) for driving the scroll (16) is rotatably mounted in a floor-mounted housing (44), the housing (40) of the gearbox (36) having a hollow output shaft (50) that is connected via a coupling (52) to the hollow drum drive shaft (24),
wherein the scroll motor (28) is configured as a flange motor, which is flange-mounted onto the floor-mounted housing (44) and which has an output shaft (30) that is nonrotatably connected to an input shaft (34) of the gearbox (36).

2. The drive apparatus according to claim 1, wherein the drive motor (18) is connected to the rotating drum (12) by a power transmission device.

3. The drive apparatus according to claim 2, wherein the power transmission device comprises a belt drive (20) having a belt pulley (22) attached between the hollow drum drive shaft (24) and the hollow output shaft (50) of the housing (40) of the gearbox (36).

4. The drive apparatus according to claim 3, wherein the belt pulley (22) is fixedly connected to the hollow drum drive shaft (24) which is mounted in a radial bearing (26), while the belt pulley (22) is connected via the coupling (52) to the hollow output shaft (50) of the housing (40) of the gearbox (36).

5. The drive apparatus according to claim 3, wherein the belt pulley (22) is connected via the coupling (52) to the hollow drum drive shaft (24) mounted in a radial bearing (26), while the belt pulley (22) is fixedly connected to the hollow output shaft (50) of the housing (40) of the gearbox (36).

6. The drive apparatus according to claim 1, wherein the coupling (52) is configured as a toothed coupling.

7. A drive apparatus in a scroll centrifuge comprising:
a rotating drum (12);
a scroll (16) mounted coaxially therein;
a drive motor (18) associated with the drum (12); and
a scroll motor (28) coupled to a scroll shaft (38) via a gearbox (36) having a housing (40) nonrotatably connected to a hollow drum drive shaft (24),
wherein the housing (40) of the gearbox (36) for driving the scroll (16) is rotatably mounted in a floor-mounted housing (44), the housing (40) of the gearbox (36) having a hollow output shaft (50) that is connected via a coupling (52) to the hollow drum drive shaft (24),
wherein the drive motor (18) is connected to the rotating drum (12) by a power transmission device, and
wherein the power transmission device comprises a spur gear gearbox (54) that is in engagement with an external tooth set (56) of the housing (40) of the gearbox (36).

8. The drive apparatus according to claim 7, wherein a housing (58) of the spur gear gearbox (54) is connected fixedly to the floor-mounted housing (44).

9. A drive apparatus in a scroll centrifuge comprising:
a rotating drum (12);
a scroll (16) mounted coaxially therein;
a drive motor (18) associated with the drum (12); and
a scroll motor (28) coupled to a scroll shaft (38) via a gearbox (36) having a housing (40) nonrotatably connected to a hollow drum drive shaft (24),
wherein the housing (40) of the gearbox (36) for driving the scroll (16) is rotatably mounted in a floor-mounted housing (44), the housing (40) of the gearbox (36) having a hollow output shaft (50) that is connected via a coupling (52) to the hollow drum drive shaft (24),
wherein the gearbox (36) has an intermediate gearbox stage (60) having a drive gear (70), driven by an output shaft (30) of the scroll motor (28), that meshes with a pinion (64) of the gearbox (36), an axis (30') of the drive gear (70) and of the output shaft (30) of the scroll motor (28) being offset with respect to a rotation axis (38') of the scroll (16) and of the pinion (64).

10. The drive apparatus according to claim 9, wherein a lubricant delivery tube (66) is guided through the intermediate gearbox stage (36) coaxially with the rotation axis (38') of the scroll (16).

* * * * *